United States Patent [19]

Drews

[11] 4,063,619

[45] Dec. 20, 1977

[54] ELEVATOR PLATFORM STRUCTURE

[76] Inventor: Robert E. Drews, 25 Faye Drive, Taylor Mill, Ky. 41015

[21] Appl. No.: 739,611

[22] Filed: Nov. 8, 1976

[51] Int. Cl.[2] ..... B66B 7/00

[52] U.S. Cl. ..... 187/17; 187/1 R

[58] Field of Search ..... 187/1 R, 8.41, 8.52, 187/9 R, 17, 97; 182/141

[56] References Cited

U.S. PATENT DOCUMENTS

| | | | |
|---|---|---|---|
| 1,509,375 | 9/1924 | Nolan | 187/97 |
| 3,054,519 | 9/1962 | Fleming | 187/9 R |
| 3,172,501 | 3/1965 | Ramer | 187/9 R |
| 3,341,042 | 9/1967 | Carder | 187/9 R |
| 3,521,775 | 7/1970 | Vermette | 187/9 R |
| 3,702,645 | 11/1972 | Shaw | 187/1 R |
| 3,749,201 | 7/1973 | Clarke | 187/9 R |
| 3,945,469 | 3/1976 | Dorcich | 187/6 |

FOREIGN PATENT DOCUMENTS

| | | | |
|---|---|---|---|
| 637,840 | 3/1962 | Canada | 187/9 R |
| 289,616 | 3/1965 | Netherlands | 187/8.41 |

*Primary Examiner*—Evon C. Blunk
*Assistant Examiner*—Jeffrey V. Nase

[57] ABSTRACT

An elevator platform structure that basically includes a framework having side panels and an elevator platform horizontally disposed between those side panels and carried on hydraulic rams positioned within those side panels. The elevator platform includes a fixed horizontal ramp at one end edge thereof, and a pivotable ramp at the other end edge thereof. The pivotable ramp is spring biased so as to restrain same in a horizontal attitude at which the elevator platform may be loaded or unloaded over that ramp, and in a vertical attitude at which that ramp functions as a stop when the platform is loaded. The pivotable ramp is thus structured to cooperate with, e.g., a trailer's floor, during loading and unloading of that trailer. The framework, at the top thereof and adjacent to the fixed ramp end of the elevator platform, includes a safety bar extending across and above the platform to aid in protecting an operator when the elevator platform is in an elevated position.

3 Claims, 9 Drawing Figures

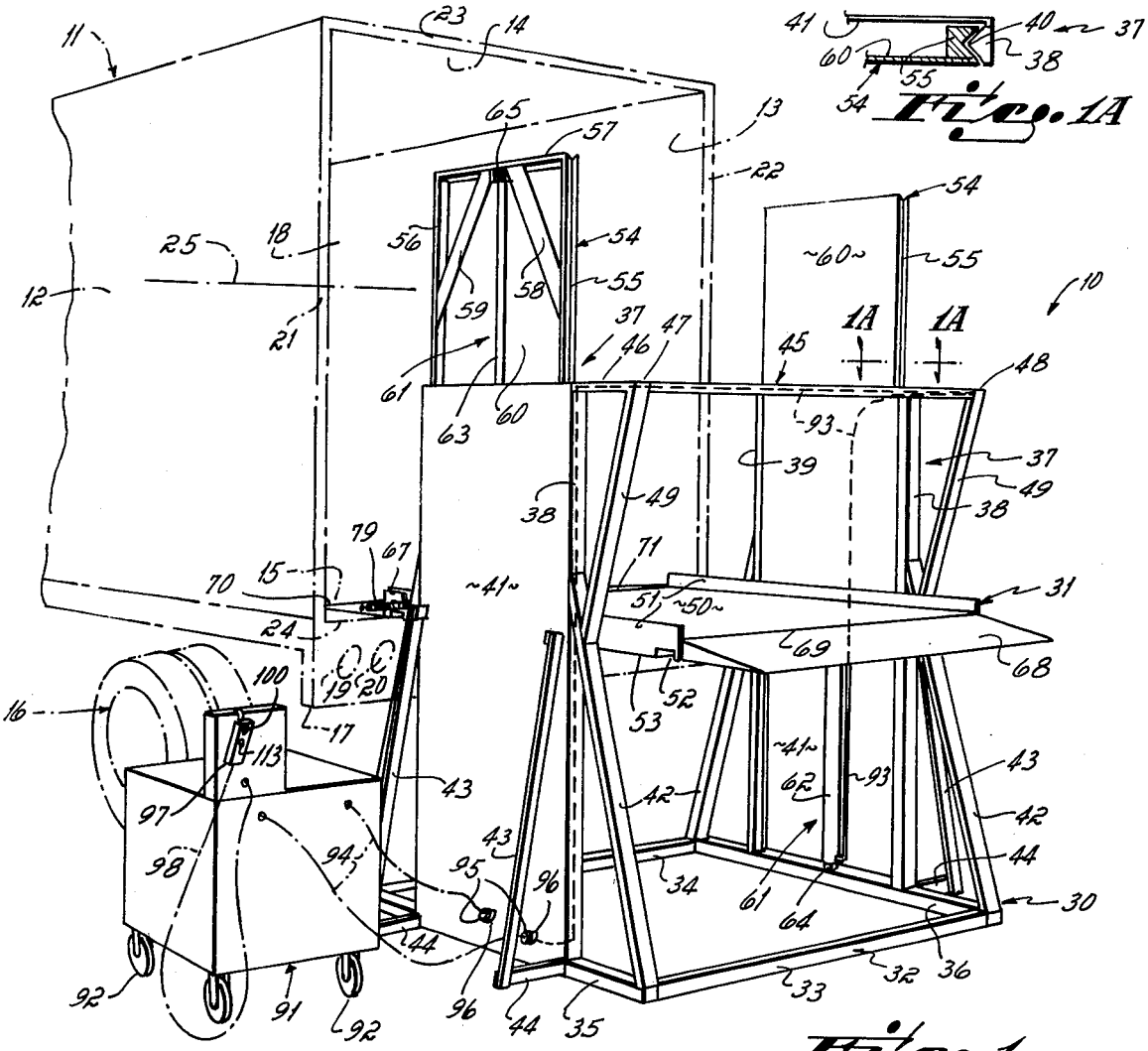
Fig. 1A
Fig. 1
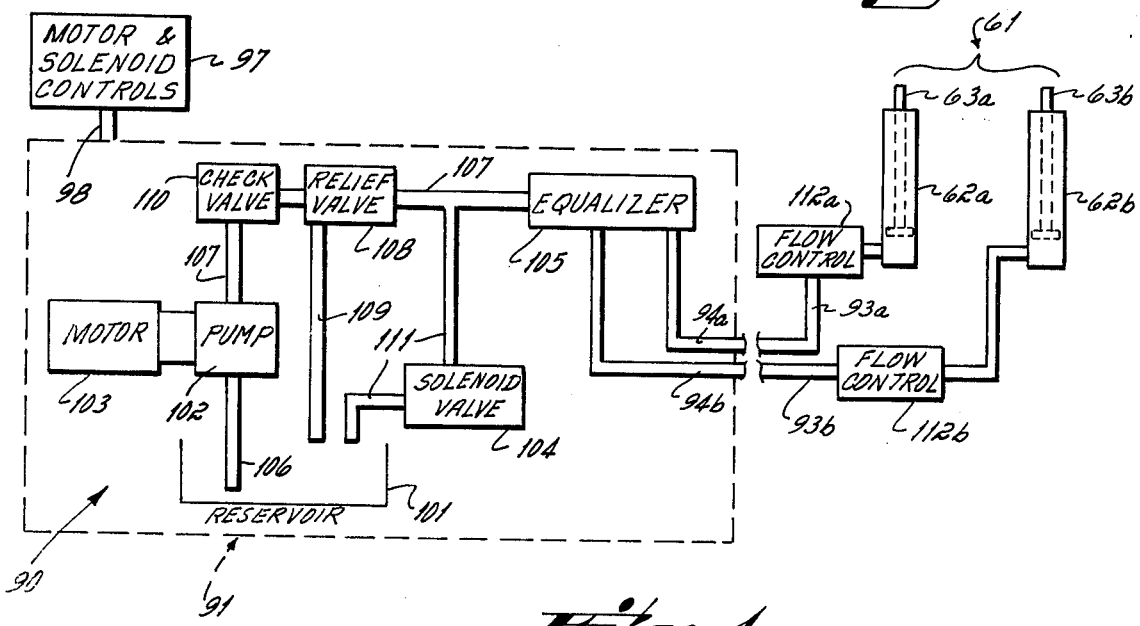
Fig. 4

ELEVATOR PLATFORM STRUCTURE

This invention relates to an improved elevator platform structure.

Over-the-road trailers, i.e., tractor trailers, are commonly used in connection with the transporting of goods in bulk. This type trailer is particularly characterized by a floor or bed substantially elevated, e.g., 4 or 5 feet or so, off ground level. It is common practice to load and unload such a trailer at dock facilities at the loading and unloading stations. Such dock facilities permit the trailer to back up into proximity with a loading dock also elevated off ground level so that the floor of the trailer is substantially coplanar with the floor of the loading dock, thereby permitting the bulk goods to be easily transferred from the trailer to, e.g., a warehouse, or vice-versa.

Also, commonly, however, the loading or unloading of the trailer must be carried out at a location at which there are no dock facilities, e.g., a retail store. In these circumstances, and in the case of heavy goods at a remote location where no mechanical unloader (e.g., a forklift truck) is available, the problem of loading or unloading the goods between the elevated trailer floor and ground level may be serious. One way to solve this situation is to provide the trailer with an elevator platform integral with, i.e., mounted on, the rear end of the trailer. Typical of such elevator platform structures integrated with a trailer are those illustrated in U.S. Pat. Nos. 3,371,805 and 3,785,678, both assigned to the assignee of this application. The elevator platform structures disclosed in these patents have operated successfully in commercial practice, and have been proven satisfactory as one structural solution to the loading/unloading problem for a trailer where no dock facilities are present.

However, not all tractor trailers are provided with integral elevator platform structures for loading and unloading at locations having no dock facilities. The loading/unloading problem remains, therefore, in those loading or unloading locations with no dock facilities, and where the trailer itself is not provided with an integral cargo platform structure therewith. In this latter situation, it is known to provide a portable elevator platform structure at a remote location having no dock facilities, that elevator platform structure being particularly adapted to move between ground level and the elevated floor level of the trailer when the trailer is backed into operational relation therewith. Typical of this type elevator platform structure is that illustrated in U.S. Pat. No. 3,749,201.

It has been one objective of this invention to provide an improved elevator platform structure, that structure having an access ramp on each of the opposed ends of the elevator platform, one of those ramps being movable between a horizontal first position whereat same permits ingress and egress off that edge of the elevator platform and a vertical second position whereat same effectively functions as a stop, the movable ramp being spring loaded so as to restrain the ramp in both of those positions, and so as to permit operational cooperation of the ramp with, e.g., the floor of a trailer during raising and lowering of the ramp relative to that floor.

It has been another objective of this invention to provide an improved elevator plaform structure as recited in the above paragraph, that structure including a safety bar operative in the platform's elevated position to prevent the operator from inadvertently backing off the platform, and inoperative at the ground position so that the operator can simply walk off the the platform with no hinderance.

In accord with these objectives and in preferred form, the elevator platform structure of this invention is directed to an elevator platform particularly designed for loading and unloading of over-the-road type trailers where there are no dock facilities. The elevator platform structure basically includes a framework having side panels, and an elevator platform horizontally disposed between those side panels and carried on hydraulic rams positioned within those side panels. The elevator platform includes a fixed horizontal ramp at one end edge thereof, and a pivotable ramp at the other end edge thereof. The pivotable ramp is spring biased so as to restrain same in a horizontal attitude at which the elevator platform may be loaded or unloaded over that ram, and a vertical attitude at which that ramp functions as a stop when the plaform is loaded, the spring bias passing an over-center point between the ramp's vertical and horizontal attitudes so that the same spring biases the ramp in both those attitudes. The pivotable ramp is thus structured to cooperate with, e.g., a trailer's floor, during loading and unloading of that trailer. The framework, at the top thereof and adjacent to the fixed ramp end of the elevator platform, includes a safety bar extending across and above the platform to aid in protecting an operator when the elevator platform is in an elevated position.

In the preferred method of use, the elevator platform structure is fixed in position on ground level. A trailer is backed into operating proximity with the platform until the rear edge of the trailer's floor is positioned substantially parallel to and between the leading edge of the pivotable ramp, and the pivot axis of the pivotable ramp, as viewed from a line of sight normal to the elevator platform when the pivotable ramp is horizontally disposed. In the ground level position, the pivotable ramp is vertically oriented, the springs biasing that access ramp in the vertical attitude. An operator stands on the elevator platform and activates the platform's hydraulic mechanism to raise the platform until at least coplanar relation of the platform with the trailer's floor is achieved. In this elevated position, the pivotable ramp is kicked down by the operator against the spring bias into the horizontal attitude, thereby providing a substantially horizontal ramp or bridge which permits the operator to transfer cargo on, e.g., carts, within the trailer onto the elevator platform or vice versa. The safety bar at the fixed ramp end of the elevator platform, being positioned above the maximum elevated position of the plaform, prevents the operator from inadvertently backing off the platform while loading or unloading the platform.

With the elevator platform loaded or unloaded, and when it is desired to lower the platform from the elevated trailer floor level to ground level, the operator simply activates the plaform's hydraulic mechanism to lower the platform, thereby causing cooperative interaction between the trailer's floor and the pivotable ramp, because that ramp overlies the trailer's floor, to pivot that ramp up into a vertical attitude. Such automatically establishes a stop for, e.g., those carts on the elevator. As the elevator platform lowers, the safety bar remains at the elevated position so that the operator can simply walk out with the carts off the rigid ramp side of the platform when the platform has achieved ground level.

Other objectives and advantages of this invention will be more apparent from the following detailed description taken in conjunction with the drawings in which:

FIG. 1 is a perspective view illustrating the improved elevator platform structure of this invention in operative position with the rear end of an over-the-road type trailer having a floor substantially elevated above ground level;

FIG. 1A is a cross-sectional view taken along line 1A—1A of FIG. 1,

FIG. 4 is a diagrammatic illustration of a fluid control circuit for the elevator platform structure;

Figure 2:
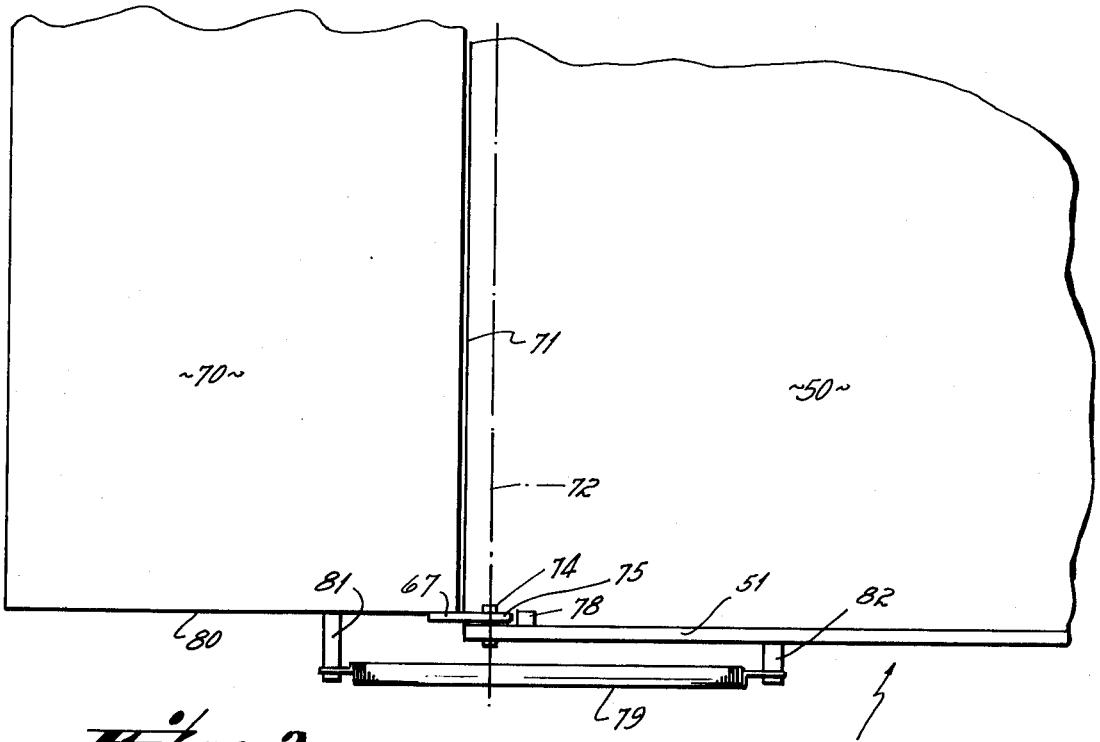
FIG. 2 is a fragmentary top view of one corner of the elevator platform illustrating the structural combination of the platform's pivotable access ramp in combination with the platform's center section.

The elevator platform structure 10 of this invention is illustrated in operative combination with an unloaded trailer 11 in FIG. 1. As shown in that Figure, the over-the-road type trailer 11 is of the commonly known commercial type comprising opposed side walls 12, 13, roof 14, and floor or bed 15. The rear end of the trailer is supported by a suitable suspension (not shown in detail), including wheels 16. An apron 17, extending downwardly from the rear opening 18 of the trailer, includes a tail light 19 and reflector 20 on each side thereof. Note particularly that the rear end of the trailer is fully opened when the trailer's doors (not shown) are not closed, so as to expose the entire interior of the trailer through the rear opening 18, that rear opening thereby being defined by the rear edges 21–24 of the side walls 12, 13, roof 14 and floor 15, those edges also defining an invisible vertical plane transverse to the longitudinal axis 25 of the trailer itself.

Figure 3:
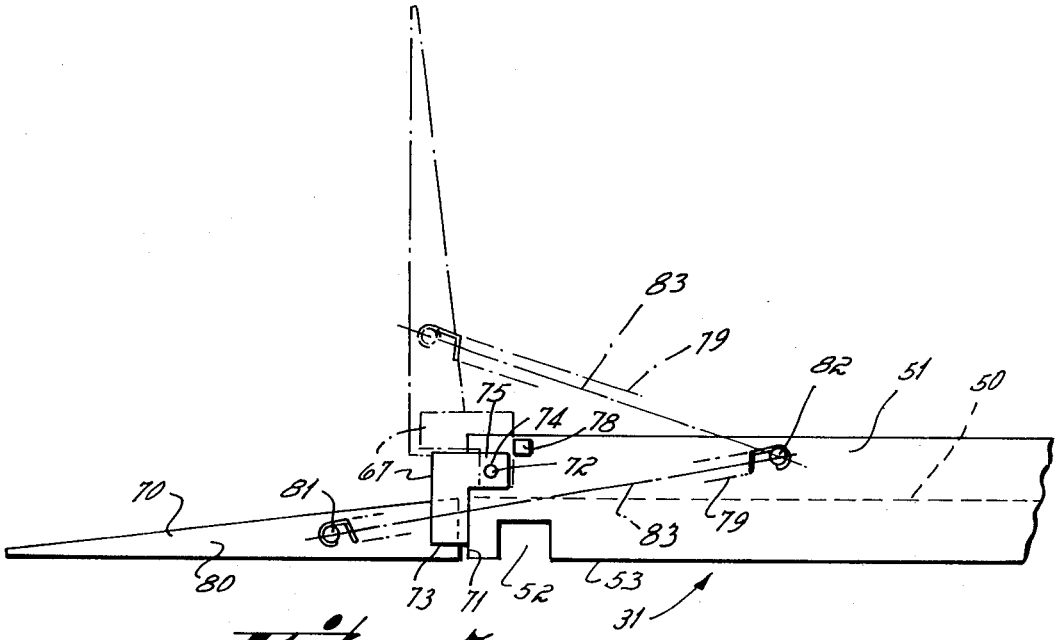
FIG. 3 is a side view of that access ramp and center section of the elevator platform illustrated in FIG. 2.

The elevator platform structure 10, as illustrated particularly in FIGS. 1–3, includes a framework 30 and an elevator platform 31. The framework 30 is adapted to rest on the ground, and may be fixed thereto or not as desired by the user. The elevator framework includes a base frame 32 having front 33 and rear 34 structural members, and side 35, 36 structural members, fixed together in a generally square configuration, see FIG. 1. Each side 35 and 36 of the base frame 32 includes an outer mast assembly 37 vertically upstanding therefrom, each outer mast assembly being positioned substantially midway between the front 33 and rear 34 structural members of that base frame, and the outer mast assemblies being positioned parallel one to the other.

Each outer mast assembly 37 is comprised of a front 38 and rear 39 mast, the masts being of angle members of generally V-shaped cross section fixed at the bottom end to a side member 35 or 36, respectively, and extending vertically upward therefrom. Note particularly that the V-shaped outer masts 38, 39 of each pair face one another, i.e., the points 40 of each V-shaped angle face toward one another in each outer mast pair 38, 39. An outer mast cover 41 is fixed to the masts 38, 39 of each pair from the top to the bottom thereof, and also is fixed to the related side base frame member 35 or 36, respectively, so as to restrain each outer mast pair 38, 39 in spaced relation one with another, and so as to enclose to some extent the mast assemblies from the exterior thereof. A fist side brace member 42 is provided in the plane of each outer mast assembly 37 for each outer mast 38, 39, the first side brace member 42 being fixed at the bottom end to the respective base frame side member 35 or 36 and at the top end to the respective outer mast 38 or 39 so as to reinforce structurally those masts. A second side brace member 43 is provided for each outer mast 38 and 39 of each mast assembly 37 in a plane normal to the plane of the respective mast assembly, each of the several brace members 43 being connected at the top end to a respective outer mast 38 or 39 and being connected at the bottom end at a location spaced away from the base frame 32 to a foot member 44 fixed to a base frame side member 35 or 36, thereby further structurally reinforcing those outer masts 38, 39.

The elevator framework, as illustrated particularly in FIG. 1, also includes a safety bar or handrail 45 spaced forward of the outer mast assemblies 37, and normal to those two assemblies 37. This safety bar 45 is connected to the front outer mast 38 of each outer mast pair 38, 39 by an arm section 46 interconnecting respective ends 47, 48 of that bar 45 with the top ends of the front outer masts 38. A brace member 49 is provided at each end 47, 48 of the safety bar 45, to retain that bar in its horizontal and elevated position, each brace being connected at its upper end to the safety bar 45 at a respective corner 47, 48 thereof and at its lower end to a respective first brace 42 for the outer mast assembly. Thus, the safety rail 45 is mounted in a structurally rigid and immobile manner relative to the rest of the elevator framework 30 and relative to the elevator platform 31 itself.

The elevator platform 31 includes a center platform section 50 that is structurally rigid, that platform section being sized to overlie the base frame 32 of the elevator framework 30 structure. The center platform section 50 also includes upstanding rail plates 51 disposed along its side edges and cutouts 52 in the bottom edges 53 of those rail plates to fit over the front 33 and rear 34 structural elements of the base frame 32 when the platform is in the ground attitude, see FIGS. 1 and 5.

The center platform section 50 of the elevator platform 31 mounts an inner mast assembly 54 on each of the opposed side edges thereof, the inner mast assemblies being vertically upstanding relative to the horizontal plane of the center platform section and being parallel to the outer mast assemblies 37. Each inner mast assembly 54 includes a pair of inner masts 55, 56, each inner mast being fixed at its bottom end to a respective side rail plate 51. The masts 55, 56 of each inner mast pair are connected at the top end by horizontal head member 57. Brace members 58, 59 which span the top corners of each inner mast assembly 54, are provided to reinforce each inner mast 55, 56 structure. An inner mast cover 60 is mounted on each pair of inner masts 55,

56 to enclose a hydraulic elevating mechanism 61 disposed between each set of inner 54 and outer 37 mast assemblies. Each inner mast 55, 56 is of an inverted V-shaped configuration, and is adapted to cooperate with the related out mast 38 or 39 (in structural assembly) to establish guideways by which the platform 31 is guided in its vertical elevator motion, see FIG. 1A.

Each hydraulic elevating mechanism 61, as illustrated in FIGS. 1 and 4, comprises a hydraulic cylinder 62 and rod 63 for each of the inner 54/outer 37 sets of mast assemblies. The bottom of each hydraulic cylinder 62 is pivotally connected, as at 64, to a respective side member 35 or 36 of the main frame 32, and the top of the cylinder rod 63 is pivotally connected, as at 65, to the respective head member 57 of the respective inner mast assembly 54, thereby interconnecting the inner 54 and outer 37 mast assemblies (i.e., the inner mast assembly and the elevator framework 30) on each side of the elevator platform 31 by the hydraulic elevating mechanism 61.

Figure 5:
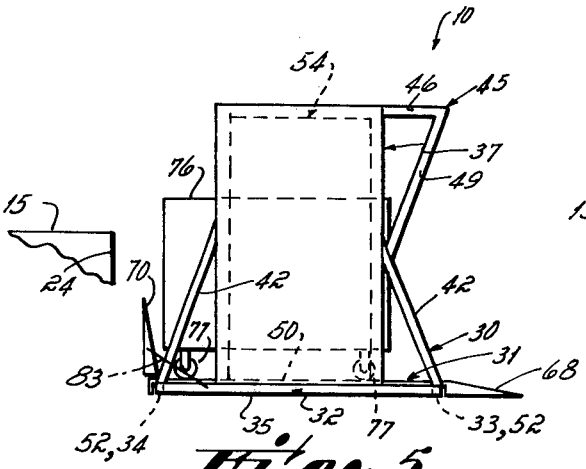
FIG. 5 is a diagrammatic view of the elevator platform in operative relation with a trailer's floor or bed, the platform being disposed at ground level where it may be loaded or unloaded.

A first or front ramp 68 is connected to the front edge 69 of the center platform section 50 along the entire width of that section, that front ramp being immobile or fixed relative to the center section, see FIG. 1. The front ramp 68 provides ingress and egress to the center platform section when the elevator platform structure is disposed at ground level as illustrated in FIG. 5. Note also, and particularly, that a second or rear ramp 70 is connected along the rear edge 71 of the center platform section 50, that rear ramp being pivotally connected to the center platform section along pivot axis 72 adjacent to the rear edge 71 and normal to the planes of the inner 54 and outer 37 mast assemblies, see FIGS. 1–3. The rear ramp 70 is connected to the center elevator section 50 by a pair of bellcrank arm members 67, each arm 67 being rigidly fixed at forearm portion 73 to the ramp 70 and being pivotally connected on pin 74 at upper arm 75 to a side rail plate 51 of the platform's center portion 50. The pins 74, of course, define pivot axis 72. The forearm portion 73 of each bellcrank arm 67 is adapted to abut against a first stop, in the form of the leading or front edge 71 of the center platform section 50, when the ramp 70 is in the ingress/egress attitude illustrated in solid lines in FIG. 3. In this attitude the second or rear ramp 70 is positioned to permit ingress and egress of, e.g., cargo carts 76 on wheels 77 from the center platform section 50 when the elevator platform 31 is in an elevated or trailer bed 15 attitude illustrated in FIG. 7. The rear ramp 70 is pivotable as previously mentioned, on pivot axis 72, to a vertically upraised or stop attitude illustrated in phantom lines in FIG. 3. In this attitude, the upper arm section 75 of each bellcrank arm 67 abuts a second stop in the form of a stop pin 78 mounted to each side rail plate 51 of the center platform section 50, thereby preventing ingress and egress of, e.g., cargo carts 76 on wheels 77 from the center platform section 50 when the elevator platform 31 is in an elevated or off-ground attitude.

A tension spring 79 interconnects each side edge 80 of the rear ramp 70 with its related side 51 of the center platform section 50. The tension spring 79 is connected at one end to pin 81 fixed to the ramp 70, and connected at the other end to pin 82 fixed to the center elevator section 50. Note particularly the orientation of each tension spring 79 relative to the pivot axis 72 of the rear ramp 70 section in both the horizontal or load/unload attitude illustrated in solid lines in FIG. 3, and the upraised or stop attitude illustrated in phantom lines in FIG. 3, when the spring 79 is viewed from a line of sight coaxial with that pivot axis 72. In the lowered or normal ramp attitude, the axis 83 of each tension spring 79 is disposed on one side of (i.e., below) the pivot axis 72 of the ramp 70, thereby positively restraining the ramp in the solid line or ramp operative attitude shown in FIG. 3. Note also that the axis 83 of the tension spring 79 is located on the other side, or over center of the ramp's pivot axis 72, the ramp 70 is in the stop or upraised attitude illustrated in phantom lines in FIG. 3, thereby also positively restraining the ramp in that stop attitude. Such is important in the functional interrelation of the elevator platform 31 structure with a trailer's bed 15 as described in more detail below.

A hydraulic circuit 90 by which the raising and lowering of the elevator platform 31 of this invention is controlled is particularly illustrated in FIG. 4. As shown in FIGS. 1 and 4, the main part of the hydraulics 90 is located in a housing 91 on wheels 92, that portion of the hydraulics within the housing being interconnected with cylinder lines 93 in the elevator framework 30 flexible hoses 94 having first detachable couplings 95 that are selectively connectable with second couplings 96 that terminate cylinder lines 93 and are mounted on elevator framework 30. The hydraulic circuit 90 is controlled from a control box 97 separate from the housing 91 (to give mobility to the operator) and connected to the circuit 90 by electrical lead lines 98. Thus, the primary portion of the hydraulic circuit 90 can be detached from the elevator framework 30 and simply pushed into a warehouse, for example, at the end of a day's activities if the elevator platform structure is being used exterior of a lockable facility.

The hydraulic circuit housing 91 includes a reservoir 101 for the hydraulic fluid, a pump 102 driven by motor 103, a solenoid controlled drain valve 104, and a pressure equalizer device 105 as its main components. The pump 102 is connected with the reservoir 101 by the line 106 on its inlet side, and is connected with the equalizer device 105 by line 107 on its outlet side. A relief valve 108 is interposed between the equalizer device 105 and the pump 102 in line 107, the relief valve having a line 109 directed into the reservoir 101 in case of over-pressurization of the system by the pump 102 and motor 103. A one-way check valve 110 is interposed in the line 107 between the relief valve 108 from the pump 102 to prevent back flow of hydraulic fluid through the relief valve and through the pump into the reservoir 101. The solenoid drain valve 104 is connected with the line 107 between the relief valve 108 and equalizer device 105 by drain line 111, the solenoid drain valve also being connected with the reservoir 101 through the drain line 111. The solenoid drain valve 104 is normally closed to fluid flow. A separate feed line 93*a*, 94*a*, and 93*b*, 94*b*, serves respective hydraulic cylinders 62*a*, 62*b*, each of the separate feed lines extending between the equalizer device 105 and its related hydraulic cylinder. A flow control device 112*a*, 112*b* is connected upstream in each feed line 93*a*, 94*a*, and 93*b*, 94*b*, for the hydraulic cylinders 62*a*, 62*b*, adjacent each hydraulic cylinder, i.e., the flow control devices 112 are not mounted in the hydraulics housing 91 but in the framework 30. The hydraulics control box 97 includes a first control switch 100 for the motor 103, and a second switch 113 for the solenoid drain valve 104; both switches are normally open, i.e., electrical circuits (not shown) normally dead. Activation of the first control switch 100 for motor 103 on box 97 by the operator of the elevator platform structure causes the pump 102 to function with the hydraulic fluid under pressure being directed through the relief valve 108, the equalizer device 105, and feed lines 93, 94 into hydraulic cylinders 62, thereby causing the elevator platform 31 to raise or lift off ground level and elevate toward bed 15 level of the trailer 11. The equalizer device 105 functions to equalize hydraulic fluid pressure distribution to both hydraulic cylinders 62 in such a manner that the elevator platform 31 raises in an even manner so that the sets of inner 54/outer 37 mast assemblies do not bind even if the platform is unequally loaded (i.e., even if the cargo load on the platform section 50 is not equally distributed over the surface area of the platform). A preferred equalizer device 105 is that marketed by Brand Hydraulics, Inc., Owaha, Nebraska 68705 under Model No. B-100. The elevator platform 31 is retained at whatever height level desired relative to ground simply by releasing the control switch 100 for motor 103. In this attitude, the hydraulic pump 102 is not operating and the solenoid drain valve 104 remains closed, thereby maintaining the hydraulic pressure in the hydraulic circuit which maintains the elevator platform 31 at the desired level.

To lower the elevator platform 31, the solenoid control switch 113 is depressed so as to open the normally closed solenoid drain valve 104 to reservoir 101. This permits the hydraulic fluid in the hydraulic cylinders 62 to drain back into the reservoir 101, thereby permitting the elevator platform 31 to lower toward ground level from its elevated attitude. The fluid control devices 112 within the feed lines 93, 94 function to control descent of the elevator platform 31 at a desired and controlled rate. Further, the flow control devices 112 also function to maintain levelness of the elevator platform 31 on its descent in much the same functional manner as the equalizer device 105 controls the levelness of the platform on its ascent, i.e., no matter what the cargo load or weight distribution on the elevator platform itself. The fluid control devices 112 are connected with the feed lines 93 to the hydraulic rams 62 within the framework 30 of the elevator platform structure, i.e., not within the hydraulics housing 91, for safety purposes so as to control descent of the elevator platform 31 even if the hydraulic lines 93, 94 are disconnected at couples 95, 96. A preferred fluid control device is that marketed by Waterman Hydraulics Co., The preferred method of use of the elevator platform structure 10 of this invention is particularly illustrated in FIGS. 5–8. The use of the elevator structure in those Figures is illustrated in conjunction with the bed 15 of a trailer 11, such as is illustrated in FIG. 1. In this connection, and because the elevator platform structure 10 itself is positioned immobily in the desired use location, the trailer 11 is backed up to the pivotable or rear ramp 70 of the elevator structure 10 until the rear edge 24 of the trailer's bed 15 is substantially parallel to, but spaced slightly outward or away from, the pivot axis 72 of the rear ramp 70. This locates the trailer 11 in functional interrelation with the elevator platform structure 10 of this invention.

The ground loading or unloading attitude of the elevator platform structure 10 is illustrated in FIG. 5. As shown in that Figure, the elevator platform 31 is disposed at ground level with the pivotable rear ramp 70 being in the upraised or stop attitude. The ramp 70 is retained in the stop attitude, as illustrated in FIG. 5, by function of tension springs 79. It is commonly the case, in certain industries, to transport bulk goods on carts 76 with wheels 77. The vertical upraised attitude of the rear ramp 70 of the elevator platform structure 10, when the structure is used with such carts 76, prevents the carts from rolling off the rear edge 71 of the elevator's center section 50 as the elevator is being raised or lowered relative to ground level.

Figure 6:
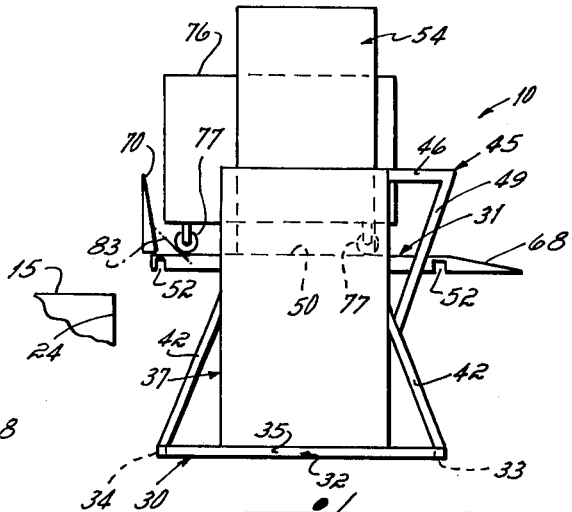
FIG. 6 is a view similar to FIG. 5 illustrating the elevator platform as it is raised toward the trailer floor level position.
Figure 7:
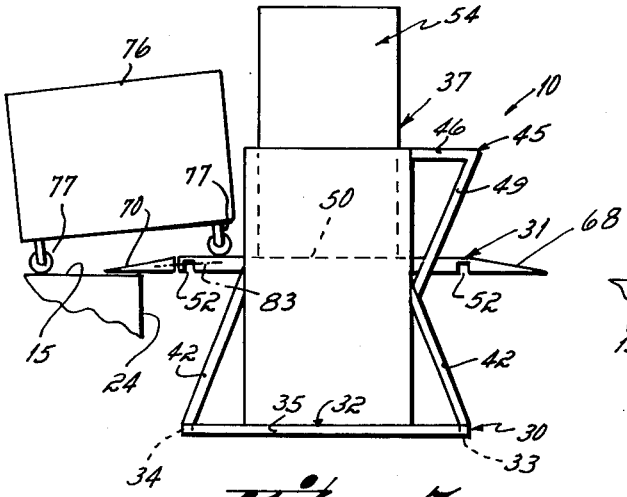
FIG. 7 is a view similar to FIG. 6 illustrating the elevator platform in the trailer floor level position with the pivotable access ramp extended into operative relation with the trailer floor where the platform may be loaded or unloaded.
Figure 8:
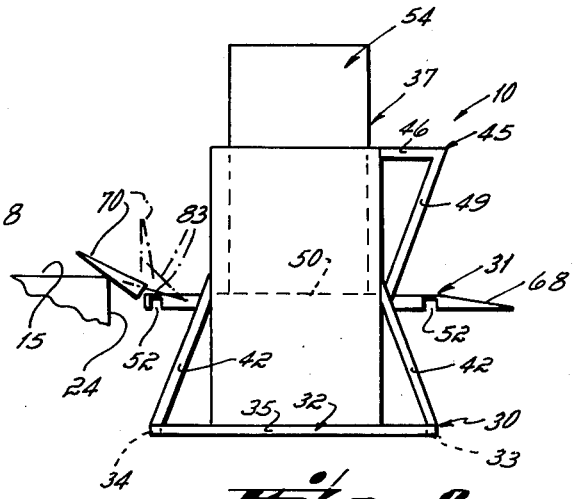
FIG. 8 is a view similar to FIG. 7 illustrating the lowering of the elevator platform from the trailer floor level position toward the ground level position.

After the elevator platform 31 has been loaded with two or more carts side-by-side, and in loading of the trailer 11 from the warehouse or other storage facility (not shown), the hydraulic circuit 90 is activated so as to raise the elevator platform 31 (as shown in FIG. 6) until the platform 31 is just slightly elevated above the bed 15 level of the trailer 11 (as shown in FIG. 7). In this upper or elevated attitude, the operator simply kicks down the rear ramp 70 of the elevator platform until the ramp is horizontally disposed with the center platform section as illustrated in FIG. 7. The rear ramp 70 is also retained in this load/unload ramp attitude by tension springs 79. In this position attitude of the pivotable rear ramp 70 section, the carts 76 may be loaded into the trailer or unloaded from the trailer relative to the elevator's center section 50. The operator unloading the trailer normally will be toward the forward edge 69 of the elevator's center platform section when the platform is in the elevated attitude, and the safety bar 45 prevents the operator from inadvertently backing off the platform 31 as it is loaded or unloaded.

After the elevator's center section 50 has been loaded or unloaded with carts 76 relative to the trailer body 11, the elevator platform 31 is simply lowered by activating the hydraulic circuit 90. As the platform 31 descends, the interaction of the fixed-in-place trailer bed 15 with the lowering center platform section 50 causes the pivotable rear ramp 70 to pivot upwardly into the stop attitude, thereby automatically positioning that pivotable ramp 70 in the stop attitude for the carts 76 on the platform 31 even should the operator forget to do so, see FIG. 8. This of course, also automatically positions the rear ramp 70 in the stop position for the next lift cycle of the elevator. The operator unloading the trailer normally will be toward the forward edge 69 of the elevator's center section 50 as the platform 31 is descending and the safety bar 45 prevents the operator from inadvertently backing off this platform 31 as it descends. The safety bar 45, because it is fixed to the top of the outer mast assemblies 37 is located above the operator when the platform 31 reaches ground level, thereby automatically removing same from the operator's way to provide ingress/egress to the platform's center section 50 when it is at ground level.

Having described in detail the preferred embodiment of my invention, what I desire to claim and protect by Letters Patent is:

1. An elevator platform structure comprising an elevator platform horizontally carried within a framework, said elevator platform being movable within said framework between a lower level and an upper level, a lifting device connecting said elevator platform and said framework, said lifting device being adapted to raise and lower said elevator platform between said upper and lower levels as desired by an operator, a pivotable ramp at one end edge of said platform, said ramp being pivotable on an axis between a first position at which said ramp is substantially horizontal with said elevator platform in a load/unload attitude, and a second position at which said ramp is vertically upraised relative to said elevator platform in a stop attitude, a bellcrank arm connecting said ramp and said platform, one end of said bellcrank arm being pivotally connected to said platform to define said axis and the other end of said bellcrank arm being fixed to said ramp, a single tension lock up spring fixed at one end to said pivotable ramp and at the other end to said elevator platform on one side of said platform, said tension spring being located on one side of said ramp axis when said ramp is in the load/unload attitude so as to retain said ramp in that position, and being located on the other side of said ramp axis when said ramp is in the stop attitude so as to retain said ramp in that position as well, a first immobile stop mounted on said elevator platform, said first stop cooperating with said bellcrank arm's upper arm portion to retain said ramp in the stop attitude as biased by said single tension spring, and a second immobile stop also mounted on said elevator platform, said second stop cooperating with said bellcrank arm's lower arm portion to retain said ramp in the load/unload attitude as biased by said single tension spring.

2. An elevator platform structure as set forth in Claim 1 including a safety bar connected to said framework, said safety bar being fixed in place against vertical movement, said safety bar extending the width of said platform at that edge of said platform opposite to said ramp edge, said safety bar being disposed above said platform in a vertically stationary position when said platform is in said upper level position to aid in protecting an operator on said platform, and said safety bar remaining above said platform at the same stationary position when said platform is in said lower level position so that an operator has ingress and egress from said platform beneath said safety bar at said lower level position without hindrance by said safety bar.

3. An elevator platform structure comprising an elevator platform movable between an upper and a lower level, said elevator platform including an inner mast assembly on each side thereof, each inner mast assembly extending upwardly above said platform, a framework within which said elevator platform is horizontally disposed, said framework including an outer mast assembly on each side thereof, each inner mast assembly being slidably engaged with an outer mast assembly, a fluid motor connected between each inner mast assembly and its associated outer mast assembly for providing fluid motors on opposite sides of said elevator platform, said fluid motors being adapted to raise and lower said elevator platform between said upper and lower levels as desired by an operator, a fluid reservoir and a pump, said reservoir and pump being located in a housing separate from said framework, said housing including wheels that permit said housing to be easily rolled from a use location adjacent said elevator platform structure to a storage location remote from said elevator platform structure, a fluid hose connected between each fluid motor and said pump, said fluid hoses being detachable at said framework to permit storage of said reservoir and pump separate from said framework and platform, a single equalizer device connected between said fluid motors and said fluid pump, said equalizer device being located within said housing, said equalizer device operating to maintain levelness of the elevator platform on its ascent no matter what the weight load distribution on the elevator platform, a flow control device connected between each of said fluid motors and said equalizer device, said flow control device being connected to said framework, said flow control device functioning to maintain levelness of the elevator platform on its descent no matter what the weight load distribution on the elevator platform, a pivotable ramp at one end edge of said platform, said ramp being pivotable on an axis between a first position at which said ramp is substantially horizontal with the said elevator platform in a load/unload attitude, and a second position at which said ramp is vertically upraised relative to said elevator platform in a stop attitude, a bellcrank arm connecting said ramp and said platform, one end of said bellcrank arm being pivotally connected to said platform to define said axis and the other end of said bellcrank arm being fixed to said ramp, a tension spring fixed at one end to said pivotable ramp and at the other end to said elevator platform, said tension spring being located on one side of said ramp axis when said ramp is in the load/unload attitude so as to retain said ramp in that position, and being located on the other side of said ramp axis when said ramp is in the stop attitude so as to retain said ramp in that position as well, a first stop mounted on said elevator platform, said first stop being adapted to retain said ramp in the stop attitude as biased by said tension spring, a second stop also mounted on said elevator platform, said second stop being adapted to retain said ramp in the load/unload attitude as biased by said tension spring, and a safety bar connected to said framework, said safety bar being fixed in place against vertical movement, said safety bar extending the width of said platform at that edge of said platform opposite to said ramp edge, said safety bar being disposed above said platform in a vertically stationary position when said platform is in said upper level position to aid in protecting an operator on said platform, and said safety bar remaining above said platform at the same stationary position when said platform is in said lower level position so that an operator has ingress and egress from said platform beneath said safety bar at said lower level position without hindrance by said safety bar.

* * * * *